US010511107B2

(12) United States Patent
Masaki et al.

(10) Patent No.: US 10,511,107 B2
(45) Date of Patent: Dec. 17, 2019

(54) CONNECTOR AND SOCKET

(71) Applicant: OMRON Corporation, Kyoto (JP)

(72) Inventors: Kenichiro Masaki, Kyoto (JP); Keisuke Yano, Kyoto (JP); Tomokazu Ikeda, Kyoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 16/275,343

(22) Filed: Feb. 14, 2019

(65) Prior Publication Data

US 2019/0288411 A1 Sep. 19, 2019

(30) Foreign Application Priority Data

Mar. 14, 2018 (JP) ..... 2018-047100

(51) Int. Cl.

| | |
|---|---|
| ***H01R 9/24*** | (2006.01) |
| ***H01R 9/22*** | (2006.01) |
| ***H01R 27/00*** | (2006.01) |
| ***H01R 13/11*** | (2006.01) |
| ***H01R 31/06*** | (2006.01) |
| *H01R 9/26* | (2006.01) |

(52) U.S. Cl.

CPC ..... *H01R 9/24* (2013.01); *H01R 9/223* (2013.01); *H01R 13/113* (2013.01); *H01R 27/00* (2013.01); *H01R 31/06* (2013.01); *H01R 9/26* (2013.01)

(58) Field of Classification Search

CPC ... F16F 1/04; F16F 1/065; F16F 1/045; F16B 21/073; H01R 13/6583; H01R 13/2421; H01R 12/716

See application file for complete search history.

(56) References Cited

U.S. PATENT DOCUMENTS 4,909,744 A * 3/1990 Muto ..... H01R 31/085 439/210
5,848,917 A * 12/1998 Bechaz ..... H01R 9/2675 439/716
6,019,643 A * 2/2000 Barrat ..... H01R 9/2633 439/709

(Continued)

FOREIGN PATENT DOCUMENTS

JP 2014150014 8/2014

OTHER PUBLICATIONS

"Search Report of Europe Counterpart Application", dated Jul. 25, 2019, pp. 1-7.

*Primary Examiner* — Briggitte R. Hammond
(74) *Attorney, Agent, or Firm* — JCIPRNET

(57) ABSTRACT

A connector that can connect electronic parts in different shapes and sizes. The connector includes a body part, a first connection part, and a second connection part. The body part is attached to a socket. The first connection part and the second connection part are arranged side by side along a first direction and connected to the body part respectively. The first connection part has a first contact part and a second contact part that are disposed opposite to each other with a gap in a second direction. The second connection part has a third contact part and a fourth contact part that are disposed opposite to each other with a gap in the second direction. A shortest distance between the first contact part and the second contact part is set greater than a shortest distance between the third contact part and the fourth contact part.

9 Claims, 4 Drawing Sheets

(56) References Cited

U.S. PATENT DOCUMENTS

| | | | | |
|---|---|---|---|---|
| 7,491,096 | B1 * | 2/2009 | Correll | H01R 9/2408<br>439/716 |
| 2011/0111634 | A1 | 5/2011 | Ruffner | |
| 2013/0052884 | A1 * | 2/2013 | Hanses | H01R 9/2683<br>439/816 |
| 2014/0065892 | A1 * | 3/2014 | Jun | H01R 4/4827<br>439/787 |
| 2017/0237186 | A1 * | 8/2017 | France | H01R 9/2416<br>439/722 |

* cited by examiner

CONNECTOR AND SOCKET

CROSS-REFERENCE TO RELATED APPLICATION

This application claims priority benefits of Japan Patent Application No. 2018-047100 filed on Mar. 14, 2018. The entirety of each of the above-mentioned patent applications is hereby incorporated by reference herein and made a part of this specification.

BACKGROUND

Technical Field

The disclosure relates to a connector housed inside a socket and the socket including the connector.

Description of Related Art

Patent Document 1 discloses a relay terminal block that can be held on a DIN (Deutsches Institut fur Normung) rail. The relay terminal block includes a substantially rectangular parallelepiped block, which has a plurality of terminal parts constituted by terminal plates, washers, and screws.

RELATED ART

Patent Document

[Patent Document 1] Japanese Laid-open No. 2014-150014

However, electronic parts such as boards or connector pins are housed inside the block of the relay terminal block. These electronic parts usually have connection terminals in different shapes and sizes for various types of electronic parts, and in order to connect these electronic parts, it is necessary to use dedicated connectors. Therefore, the number of parts of the relay terminal block increases, which may increase its manufacturing cost.

The disclosure provides a connector capable of connecting electronic parts that have terminals in different shapes and sizes, and a socket including the connector.

SUMMARY

A connector according to an example of the disclosure is adapted to be housed inside a socket that includes a first terminal connection part, which is capable of connecting a first terminal, and a second terminal connection part, which is capable of connecting a second terminal and electrically connected to the first terminal connection part. The connector is disposed in a conduction path connected to the first terminal connection part and the second terminal connection part. The connector includes:

a body part is adapted to be attached to the socket; and a first connection part and a second connection part arranged side by side along a first direction and connected to the body part respectively, wherein the first connection part includes:

a first contact part and a second contact part disposed opposite to each other with a gap in a second direction that intersects the first direction, wherein the first contact part is configured to be elastically deformable in the second direction and in a direction away from the second contact part, and wherein the second connection part includes:

a third contact part and a fourth contact part disposed opposite to each other with a gap in the second direction, wherein the third contact part is configured to be elastically deformable in the second direction and in a direction away from the fourth contact part, wherein a shortest distance between the first contact part and the second contact part is set greater than a shortest distance between the third contact part and the fourth contact part.

In addition, a socket according to an example of the disclosure includes the connector.

DESCRIPTION OF THE EMBODIMENTS

Hereinafter, an example of the disclosure will be described with reference to the accompanying drawings. In the following description, terms (for example, terms including "upper", "lower", "right", and "left") that indicate specific directions or positions are used as necessary. However, these terms are used to facilitate understanding of the disclosure with reference to the drawings, and the technical scope of the disclosure is not limited by the meanings of these terms. In addition, the following description is merely exemplary and is not intended to limit the disclosure, its application, or its usage. Furthermore, the drawings are schematic, and the ratio of the dimensions does not necessarily agree with the actual one.

Figure 1:
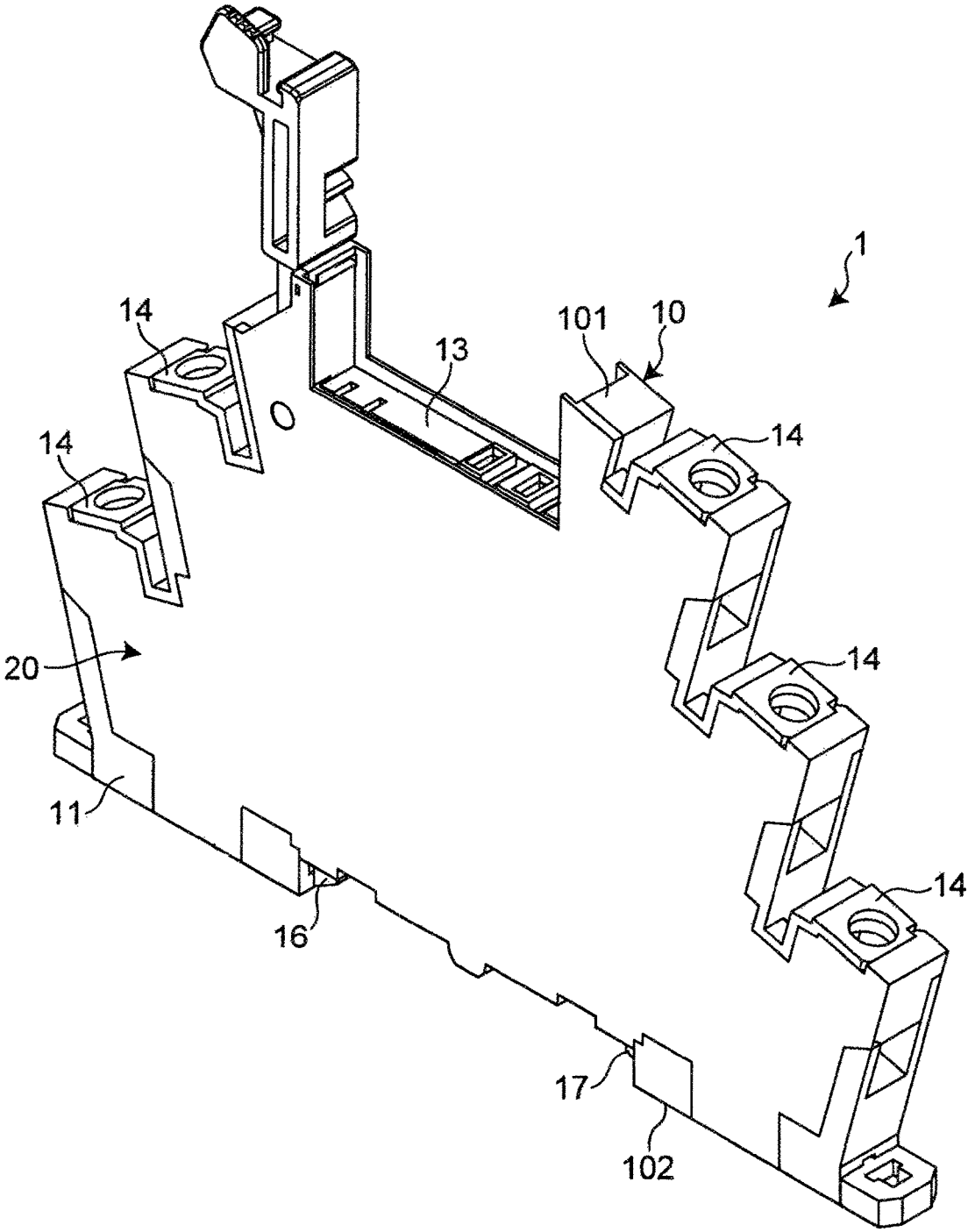
FIG. 1 is a perspective view showing a socket according to an embodiment of the disclosure.
Figure 2:
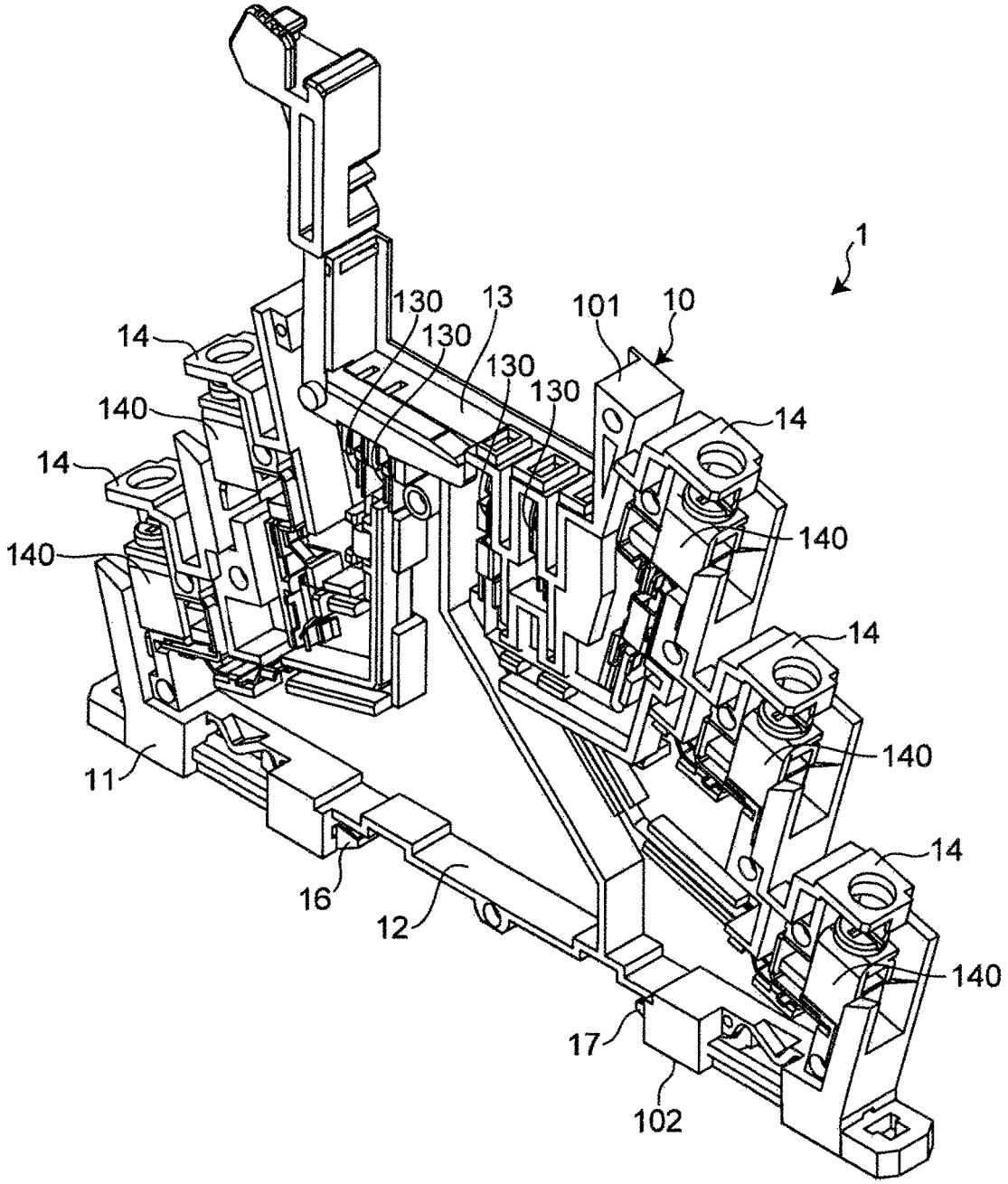
FIG. 2 is a perspective view of the socket of FIG. 1 with a case removed.

As shown in FIG. 1, a socket 1 of an embodiment of the disclosure includes a base 10 having an elongated box shape and a case 20 attached to the base 10. As shown in FIG. 2, the base 10 has an opening surface 11 formed with a housing opening 12. The case 20 is attached to the base 10 to cover the housing opening 12 of the opening surface 11.

As shown in FIG. 1, the base 10 has a first side 101 and a second side 102. The first side 101 intersects the opening surface 11, and the second side 102 is opposite to the first side 101. Each of the first side 101 and the second side 102 has a substantially rectangular shape as viewed in the direction that intersects the first side 101 and the second side 102.

A device connection part 13, which can connect an electronic device such as an electromagnetic relay, is disposed at substantially the center of the first side 101 of the base 10 in the longitudinal direction thereof. In addition, wire connection parts 14, which can connect wires respectively, are disposed on two sides of the device connection part 13 in the longitudinal direction of the first side 101. As an example, a plurality of wire connection parts 14 are disposed and arranged side by side in a line at equal intervals along the longitudinal direction of the first side 101.

Two wire connection parts 14 are disposed on one side of the first side 101 in the longitudinal direction with respect to the device connection part 13 and three wire connection parts 14 are disposed on the other side of the first side 101 in the longitudinal direction with respect to the device connection part 13. Furthermore, as shown in FIG. 1, a first locking part 16 and a second locking part 17 are respectively provided at two end portions of the second side 102 of the base 10 in the longitudinal direction. The first locking part 16 and the second locking part 17 are configured to lock to the base 10 to a rail (for example, a DIN rail).

As shown in FIG. 2, the device connection part 13 is provided with first terminal connection parts 130, which can connect a terminal (an example of the first terminal) of the electromagnetic relay, for example. In addition, each wire connection part 14 is provided with a second terminal connection part 140, which can connect a conductor part (an example of the second terminal) of a wire. The first terminal connection parts 130 and the second terminal connection parts 140 are electrically connected inside the base 10 and the case 20.

Figure 3:
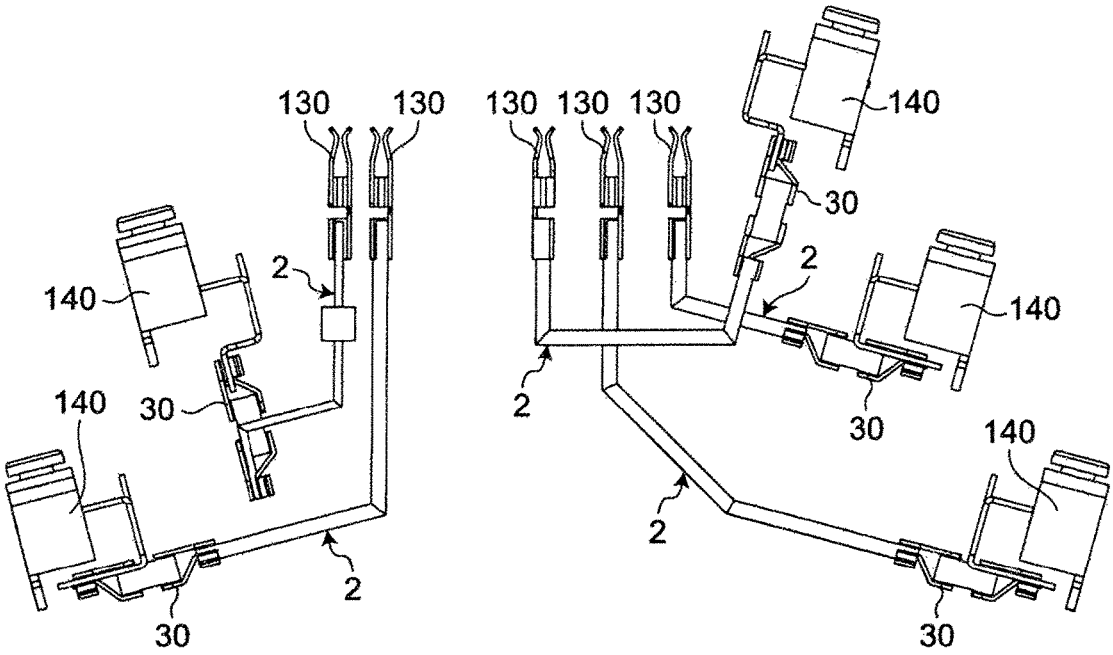
FIG. 3 is a plan view of the socket of FIG. 1 with a base and the case removed.

As shown in FIG. 3, a connector 30 of an embodiment of the disclosure is disposed in a conduction path 2 that is connected to the first terminal connection part 130 and the second terminal connection part 140. In FIG. 3, the configurations other than the connector 30, the first terminal connection part 130, the second terminal connection part 140, and the conduction path 2 are omitted.

Figure 4:
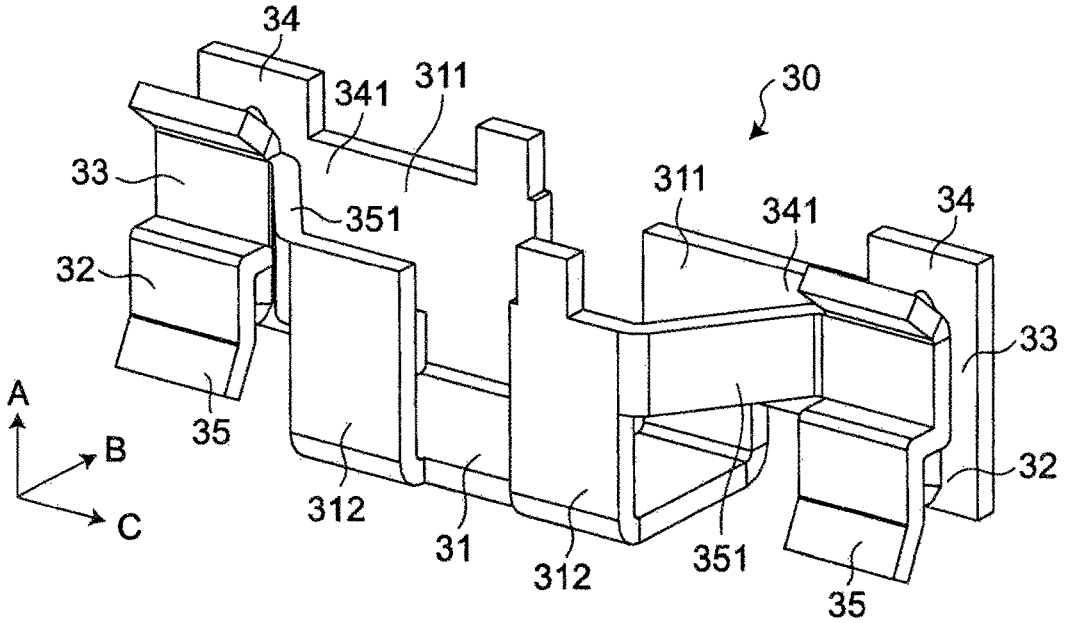
FIG. 4 is a perspective view of a connector according to an embodiment of the disclosure.

As shown in FIG. 4, the connector 30 includes a body part 31, a first connection part 32, and a second connection part 33. The body part 31 is attached to the socket 1. The first connection part 32 and the second connection part 33 are arranged side by side along a first direction A and are connected to the body part 31 respectively. As an example, the connector 30 is integrally formed of a metal plate-shaped member and has two groups of first connection parts 32 and second connection parts 33. The two groups of first connection parts 32 and second connection parts 33 are disposed to sandwich the substantially rectangular plate-shaped body part 31 in the longitudinal direction thereof.

Figure 5:
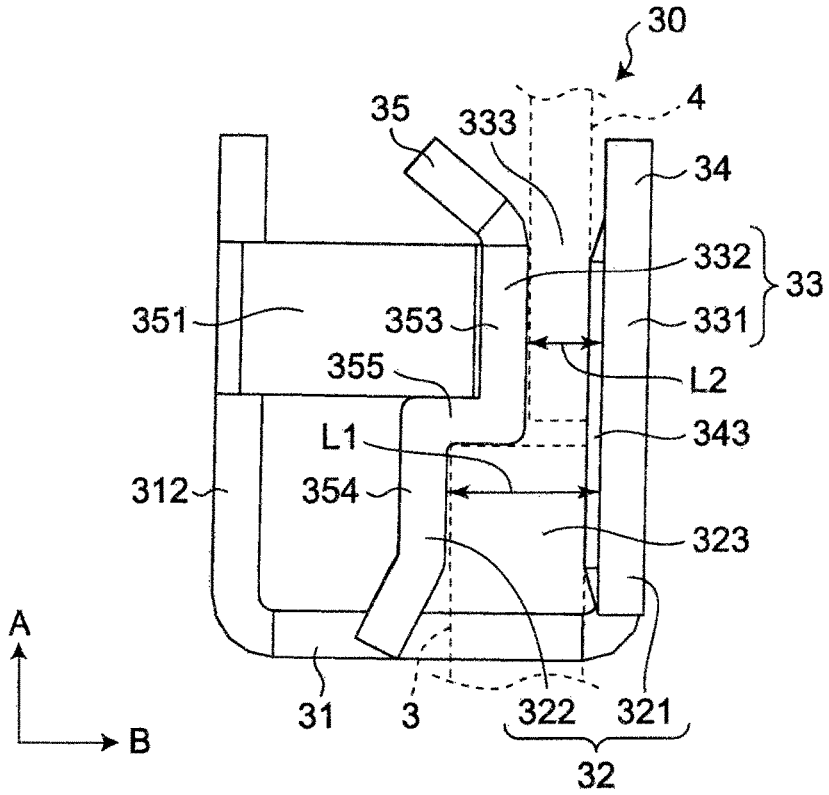
FIG. 5 is a side view of the connector of FIG. 4.

As shown in FIG. 5, the first connection part 32 has a first contact part 321 and a second contact part 322, which are arranged opposite to each other with a gap 323 therebetween in a second direction B (that is, the longitudinal direction of the body part 31) that intersects (for example, is orthogonal to) the first direction A. Further, the second connection part 33 has a third contact part 331 and a fourth contact part 332, which are arranged opposite to each other with a gap 333 therebetween in the second direction B.

Specifically, as shown in FIG. 4, a pair of first support plate 311 and second support plate 312 is disposed respectively at two end portions of the body part 31 in the longitudinal direction. The first support plate 311 and the second support plate 312 extend in the first direction A from two edges of the body part 31 in the transverse direction. A first contact plate 34 and a second contact plate 35 are connected to the support plates 311 and 312 respectively and are opposite to each other.

As shown in FIG. 4, the first contact plate 34 has a substantially rectangular plate shape extending in the first direction A and is connected to the first support plate 311 by a first intermediate plate 341. The first support plate 311, the first intermediate plate 341, and the first contact plate 34 are arranged side by side in a line along a third direction C (that is, on the same virtual plane including the first direction A and the third direction C) that intersects (for example, is orthogonal to) the first direction A and the second direction B.

As shown in FIG. 5, two end portions of the first contact plate 34 in the first direction A constitute the first contact part 321 of the first connection part 32 and the third contact part 331 of the second connection part 33 respectively.

As an example, the first contact plate 34 (that is, the first contact part 321 and the third contact part 331) is configured to be elastically deformable in the second direction B and in the direction away from the second contact plate 35. Moreover, a contact portion 343 is disposed from one end portion to the other end portion in the first direction A on the inner surface of the first contact plate 34, which faces the second contact plate 35. The contact portion 343 protrudes from the inner surface toward the second contact plate 35.

As shown in FIG. 4, the second contact plate 35 has a stepped shape extending in the first direction A and is connected to the second support plate 312 by a second intermediate plate 351.

As shown in FIG. 5, the second contact plate 35 has a proximal plate 353 and a distal plate 354. The proximal plate 353 is disposed closer to the first contact plate 34 in the second direction B than the second support plate 312 and faces the first contact part 321 of the first contact plate 34. The distal plate 354 faces the third contact part 331 of the first contact plate 34. The distal plate 354 is disposed between the second support plate 312 and the proximal plate 353 as viewed in the third direction C.

The distal plate 354 of the second contact plate 35 constitutes the second contact part 322 of the first connection part 32 and the proximal plate 353 constitutes the fourth contact part 332 of the second connection part 33. That is, the shortest distance L1 between the first contact part 321 and the second contact part 322 is set greater than the shortest distance L2 between the third contact part 331 and the fourth contact part 332. Thus, for example, as shown in FIG. 5, a relatively large terminal 3 of the electronic part can be inserted between the first contact part 321 and the second contact part 322 in the first direction A and the third direction C, and a relatively small terminal 4 of the electronic part can be inserted between the third contact part 331 and the fourth contact part 332 in the first direction A and the third direction C.

A stepped portion 355 is formed at the boundary between the proximal plate 353 and the distal plate 354. For example, the stepped portion 355 can stop the relatively large terminal 3 of the electronic part inserted to the first connection part 32 in the first direction A to regulate its position.

As an example, the second contact plate 35 (that is, the second contact part 322 and the fourth contact part 332) is configured to be elastically deformable in the second direction B and in the direction away from the first contact plate 34. Moreover, two end portions of the second contact plate 35 in the first direction A are bent respectively in the direction away from the first contact plate 34. Thus, it is easy to insert a terminal into the gap 323 of the first connection part 32 and the gap 333 of the second connection part 33.

The second intermediate plate 351 is connected to the second support plate 312 and the proximal plate 353, and is inclined in the second direction B and in the direction close to the first contact plate 34 as it goes from the support plate 312 toward the second contact plate 35 in the third direction C.

Since the second support plate 312 and the proximal plate 353 are connected by the second intermediate plate 351, the distal plate 354 is elastically deformed in the second direction B more easily than the proximal plate 353. That is, it is possible to connect more types of electronic parts to the first connection part 32.

The connector 30 includes the body part 31, the first connection part 32, and the second connection part 33. The body part 31 is attached to the socket 1. The first connection part 32 and the second connection part 33 are arranged side by side along the first direction A and are connected to the body part 31 respectively. The first connection part 32 has the first contact part 321 and the second contact part 322 that are arranged opposite to each other with the gap 323 therebetween in the second direction B. The second connection part 33 has the third contact part 331 and the fourth contact part 332 that are arranged opposite to each other with the gap 333 therebetween in the second direction B. Further, the shortest distance L1 between the first contact part 321 and the second contact part 322 is set greater than the shortest distance L2 between the third contact part 331 and the fourth contact part 332. With such a configuration, for example, a relatively large terminal can be connected to the first connection part 32 and a relatively small terminal can be connected to the second connection part 33. Therefore, it is possible to realize the connector 30 that can connect electronic parts having terminals in different shapes and sizes.

In addition, the first contact part 321 and the second contact part 322 are configured to be elastically deformable in the second direction B and in the direction away from each other, and the third contact part 331 and the fourth contact part 332 are configured to be elastically deformable in the second direction B and in the direction away from each other. Thus, the range of the size of the terminal of the electronic part that can be inserted between the first contact part 321 and the second contact part 322 can be expanded, and the range of the size of the terminal of the electronic part that can be inserted into the gap 333 between the third contact part 331 and the fourth contact part 332 can also be expanded. That is, it is possible to realize the connector 30 that can connect more types of electronic parts.

Furthermore, the first connection part 32 and the second connection part 33 are connected to the body part 31 in the third direction C that intersects the first direction A and the second direction B. Thus, the terminal of the electronic part can be connected to the first connection part 32 and the second connection part 33 not only in the first direction A but also in the third direction C, for example, and the usability of the connector 30 can be improved.

In addition, the body part 31, the first connection part 32, and the second connection part 33 are formed integrally. Thus, when they are disposed inside the socket 1, it is possible to prevent increasing the number of parts of the socket 1 to reduce the manufacturing cost of the socket 1.

That is, since the socket 1 includes the connector 30, the manufacturing cost can be reduced.

In the above embodiment, the first contact part 321 and the second contact part 322 are configured to be elastically deformable in the second direction B and in the direction away from each other, and the third contact part 331 and the fourth contact part 332 are configured to be elastically deformable in the second direction B and in the direction away from each other. However, the disclosure is not limited thereto. For example, only one of the first contact part 321 and the second contact part 322 or only one of the third contact part 331 and the fourth contact part 332 may be configured to be elastically deformable, or all the first contact part 321, the second contact part 322, the third contact part 331, and the fourth contact part 332 may not be elastically deformable.

The first connection part 32 and the second connection part 33 are not necessarily connected to the body part 31 in the third direction C, and can be connected to the body part 31 in any direction according to the design of the connector 30 or the like.

The body part 31, the first connection part 32, and the second connection part 33 are not necessarily formed integrally, and may be provided separately.

Further, in the embodiment, the first contact part 321 of the first connection part 32 and the third contact part 331 of the second connection part 33 are provided on the first contact plate 34, and the second contact part 322 of the first connection part 32 and the fourth contact part 332 of the second connection part 33 are provided on the second contact plate 35. However, the disclosure is not limited thereto. For example, the first contact part 321 and the third contact part 331 may be provided on separate plate members and connected to the first support plate 311 respectively. Likewise, the second contact part 322 and the fourth contact part 332 may be provided on separate plate members and connected to the second support plate 312 respectively.

The connector 30 of the disclosure can be used in sockets having other configurations, not limited to the socket 1.

Although various embodiments of the disclosure have been described in detail above with reference to the drawings, finally various aspects of the disclosure will be described. The following description is provided with reference numerals as an example.

A connector 30 according to the first aspect of the disclosure is housed inside a socket 1 that includes a first terminal connection part 130, which is capable of connecting a first terminal, and a second terminal connection part 140, which is capable of connecting a second terminal and electrically connected to the first terminal connection part 130, and the connector 30 is disposed in a conduction path 2 connected to the first terminal connection part 130 and the second terminal connection part 140. The connector 30 includes:

a body part 31 attached to the socket 1; and a first connection part 32 and a second connection part 33 arranged side by side along a first direction A and connected to the body part 31 respectively, wherein the first connection part 32 includes:

a first contact part 321 and a second contact part 322 disposed opposite to each other with a gap 323 in a second direction B that intersects the first direction A, and the second connection part 33 includes:

a third contact part 331 and a fourth contact part 332 disposed opposite to each other with a gap 333 in the second direction B, wherein a shortest distance L1 between the first contact part 321 and the second contact part 322 is set greater than a shortest distance L2 between the third contact part 331 and the fourth contact part 332.

According to the connector 30 of the first aspect, with the first connection part 32 and the second connection part 33, it is possible to realize the connector 30 that can connect electronic parts having terminals in different shapes and sizes.

In the connector 30 according to the second aspect of the disclosure, at least one of the first contact part 321 and the second contact part 322 is configured to be elastically deformable in the second direction B and in a direction away from each other.

According to the connector 30 of the second aspect, since the range of the size of the terminal of the electronic part that can be inserted between the first contact part 321 and the second contact part 322 can be expanded, it is possible to realize the connector 30 that can connect more types of electronic parts.

In the connector 30 according to the third aspect of the disclosure, at least one of the third contact part 331 and the fourth contact part 332 is configured to be elastically deformable in the second direction B and in a direction away from each other.

According to the connector 30 of the third aspect, since the range of the size of the terminal of the electronic part that can be inserted into the gap 333 between the third contact part 331 and the fourth contact part 332 can be expanded, it is possible to realize the connector 30 that can connect more types of electronic parts.

In the connector 30 according to the fourth aspect of the disclosure, the first connection part 32 and the second connection part 33 are connected to the body part 31 in a third direction C that intersects the first direction A and the second direction B.

According to the connector 30 of the fourth aspect, the terminal of the electronic part can be connected to the first connection part 32 and the second connection part 33 not only in the first direction A but also in the third direction C, for example, and the usability of the connector 30 can be improved.

In the connector 30 according to the fifth aspect of the disclosure, the body part 31, the first connection part 32, and the second connection part 33 are formed integrally.

According to the connector 30 of the fifth aspect, when it is disposed inside the socket 1, it is possible to prevent increasing the number of parts of the socket 1 to reduce the manufacturing cost of the socket 1.

A socket 1 according to the sixth aspect of the disclosure includes the connector 30 of the above aspects.

According to the socket 1 of the sixth aspect, with the connector 30 of the above aspects, it is possible to realize the socket 1 that can reduce the manufacturing cost.

The connector includes the body part, the first connection part, and the second connection part. The body part is attached to the socket. The first connection part and the second connection part are arranged side by side along the first direction and are connected to the body part respectively. The first connection part has the first contact part and the second contact part that are arranged opposite to each other with a gap therebetween in the second direction. The second connection part has the third contact part and the fourth contact part that are arranged opposite to each other with a gap therebetween in the second direction. Further, the shortest distance between the first contact part and the second contact part is set greater than the shortest distance between the third contact part and the fourth contact part. With the first connection part and the second connection part, it is possible to realize the connector that can connect electronic parts having terminals in different shapes and sizes.

Further, in regard to the socket, the connector makes it possible to realize the socket that can reduce the manufacturing cost.

Any of the various embodiments or modified examples may be combined as appropriate to achieve the respective effects. It is also possible to combine the embodiments, to combine the examples, or to combine the embodiments with the examples, and to combine features in different embodiments or examples.

INDUSTRIAL APPLICABILITY

The connector of the disclosure can be applied to a socket used in a control panel, for example.

Furthermore, the socket of the disclosure can be used in a control panel, for example.

What is claimed is:

1. A connector adapted to be housed inside a socket that comprises a first terminal connection part, which is capable of connecting a first terminal, and a second terminal connection part, which is capable of connecting a second terminal and electrically connected to the first terminal connection part, and the connector being disposed in a conduction path connected to the first terminal connection part and the second terminal connection part, the connector comprising:

a body part adapted to be attached to the socket; and a first connection part and a second connection part arranged side by side along a first direction and connected to the body part respectively, wherein the first connection part comprises:

a first contact part and a second contact part disposed opposite to each other with a gap in a second direction that intersects the first direction, and the second connection part comprises:

a third contact part and a fourth contact part disposed opposite to each other with a gap in the second direction, wherein a shortest distance between the first contact part and the second contact part is set greater than a shortest distance between the third contact part and the fourth contact part.

2. The connector according to claim 1, wherein at least one of the first contact part and the second contact part is configured to be elastically deformable in the second direction and in a direction away from each other.

3. The connector according to claim 2, wherein at least one of the third contact part and the fourth contact part is configured to be elastically deformable in the second direction and in a direction away from each other.

4. The connector according to claim 3, wherein the first connection part and the second connection part are connected to the body part in a third direction that intersects the first direction and the second direction.

5. The connector according to claim 1, wherein the body part, the first connection part, and the second connection part are formed integrally.

6. The connector according to claim 1, wherein at least one of the third contact part and the fourth contact part is configured to be elastically deformable in the second direction and in a direction away from each other.

7. The connector according to claim 1, wherein the first connection part and the second connection part are connected to the body part in a third direction that intersects the first direction and the second direction.

8. The connector according to claim 2, wherein the first connection part and the second connection part are connected to the body part in a third direction that intersects the first direction and the second direction.

9. A socket comprising the connector according to claim 1.

* * * * *